US009161591B2

(12) United States Patent
Landau et al.

(10) Patent No.: US 9,161,591 B2
(45) Date of Patent: Oct. 20, 2015

(54) AUTONOMOUS BALANCE-ENHANCED INSERT FOR FOOTWEAR

(76) Inventors: Alexander Landau, Boulder, CO (US); Ruth Shrairman, Boulder, CO (US)

( * ) Notice: Subject to any disclaimer, the term of this patent is extended or adjusted under 35 U.S.C. 154(b) by 696 days.

(21) Appl. No.: 13/342,000

(22) Filed: Dec. 31, 2011

(65) Prior Publication Data

US 2012/0167414 A1 Jul. 5, 2012

Related U.S. Application Data

(60) Provisional application No. 61/429,002, filed on Dec. 31, 2010.

(51) Int. Cl.

| | |
|---|---|
| ***A43B 17/00*** | (2006.01) |
| ***A43B 7/14*** | (2006.01) |
| ***A43B 13/18*** | (2006.01) |

(52) U.S. Cl.

CPC ..... *A43B 7/1415* (2013.01); *A43B 7/146* (2013.01); *A43B 7/147* (2013.01); *A43B 7/149* (2013.01); *A43B 13/189* (2013.01); *A43B 17/006* (2013.01)

(58) Field of Classification Search

CPC ..... A43B 13/19; A43B 7/149; A43B 7/1415; A43B 7/146; A43B 7/28; A43B 7/00; A43B 13/189

See application file for complete search history.

(56) References Cited

U.S. PATENT DOCUMENTS

| | | | | | |
|---|---|---|---|---|---|
| 3,765,422 | A | * | 10/1973 | Smith | 36/153 |
| 5,131,174 | A | * | 7/1992 | Drew et al. | 36/35 B |
| 5,228,156 | A | * | 7/1993 | Wang | 5/677 |
| 5,564,202 | A | * | 10/1996 | Hoppenstein | 36/25 R |
| 5,784,807 | A | * | 7/1998 | Pagel | 36/93 |

* cited by examiner

*Primary Examiner* — Ted Kavanaugh

(57) ABSTRACT

An article of footwear and insert for an article of footwear are provided with means for provisional instantaneous enhancing cutaneous mechanoreceptors pressure sensation from the plantar surface (sole) of the foot perimeter zone.

Such instantaneous stimulation ought to compensate age/illness—related deterioration of plantar cutaneous sensation; it enhances its ability to detect and react to the shifts of the body's Center of Gravity (COG) toward the edges of the feet which, if left uncorrected right away, cause ankle sprain, and/or loss of balance and fall.

An insole disclosed is provided with a set of pressure-activated protrusions, which form a narrow strip in close proximity to the perimeter of the insole inside the inner neighborhood of the plantar sole perimeter, and becomes active just when the Center Of Pressure (COP) of the wearer of the footwear is shifting dangerously toward the edges of the feet.

5 Claims, 5 Drawing Sheets

AUTONOMOUS BALANCE-ENHANCED INSERT FOR FOOTWEAR

CROSS-REFERENCE TO RELATED APPLICATIONS

This application claims the benefit of U.S. Provisional Patent Application No. 61/429,002, filed Dec. 31, 2010.

BACKGROUND OF THE INVENTION

The present invention relates to inserts for footwear, as well as footwear incorporating such inserts, which stimulate cutaneous pressure sensation from the edges of the feet (perimeter of the plantar foot surface) during standing and walking, and thereby improve the ability of the wearer's CNS to keep the body's Center Of Gravity (COG) balanced and centered over the feet, particularly in persons who experience postural instability as a result of loss of cutaneous touch and pressure sensation due to aging or other factors.

DESCRIPTION OF THE PRIOR ART

Bipedal gait and purposeful movement are two astounding and unique abilities possessed by humans. Walking is a deceptively difficult and inherently unstable process that has been commonly described as a series of falls from one limb to the other. Human bipedal ambulation requires the ability to control and propel an elevated COG using just two limbs. The human lower extremities, with their relatively long levers, provide a wide range of movement and power, but inherently lead to a narrow and variable base of support.

In order to maintain stable upright stance, the COG of the body must be positioned over this narrow base of support established by the feet. Orthopedic injuries may occur if the body weight is shifted too close to the limits of this base of support, i.e. too close to the perimeter of the plantar foot surface.

In order to consistently accomplish this remarkable unconscious feat of both bipedal mobility and stability, the Central Nervous System (CNS) requires continuous, accurate, and sufficient plantar somatosensory information to be able to make necessary motor adjustments to maintain balance.

During any static or dynamic weighted activity, somatosensory nerve endings on the bottom of the feet sense the surface beneath, and direct signals to the CNS, which by unconscious reflexive occurrences determine how and where weight should be distributed with each new step. When a person is in footwear, this feedback mechanism is altered. The thicker the insole, the more muffled the sensory afferent message.

Numerous experimental studies acknowledge today the importance of cutaneous sensation from the plantar surface. This surface serves as a "dynamometric map" for the CNS to control dynamic balance, where the cutaneous sensations act to trigger and modulate the automatic postural reflexes and reactions that work to control loaded ankle joint inversion movements.

The plantar-surface mechanoreceptors provide information about weight distribution, control during single leg support, and the limits of the anterior and posterior base of support. With normal aging, after the age of 40 impairments in the ability to sense loss of balance begin to occur. Afferent receptors that sense movement and pressure changes in the soles of the feet start to disappear so the brain doesn't get a clear message of what is underfoot. Even healthy older adults can have a profound loss of this pressure sensation, and subsequent loss of protective balance and righting reactions, and yet have no idea that there is a problem.

Various footwear inserts and articles of footwear have been developed which incorporate raised protrusions of various shapes and sizes in various areas of the upper and/or lower surface of the insole. Invariably, these inserts have been designed for purposes other than improving postural balance and preventing falls.

Exclusion of this long list of footwear inserts is the work of one of the leading investigators in the biomechanics of balance and falls in the world, Dr. Brian E. Maki, (Maki at el., U.S. Pat. No. 6,237,256 BI), which provides an insert with a means for stimulating cutaneous pressure sensation from the perimeter of the plantar foot surface (foot sole) whenever the wearer's Center of Pressure (COP) shifts toward the edges of the feet.

Subsequently, collective of scientists headed by Dr. Brian Maki have developed a special insole called "SoleSensor" with a permanent narrow, elongated, raised ridge located in close proximity to the perimeter of the sole to stimulate cutaneous pressure sensation from the perimeter of the plantar surface of the foot whenever the wearer's COP shifts toward a periphery of the plantar foot surface during standing or walking.

Shortcomings of such permanently raised ridge are twofold:

first—should the insert be worn often, the brain will adapt to the signals sent from the stimulated nerves in the foot and will no longer respond to the signals, so the proprioception of the subject will no longer be enhanced, thus over long periods of time, balance will not be improved, and second—such a permanent ridge might create discomfort/irritation that will gradually result in desensitization of the affected part of the sole's somatosensory systems, i.e., could eventually result in a reverse effect the person's balance.

Note that "SoleSensor" explore only part of structure claimed in U.S. Pat. No. 6,237,256 BI: the ridges, which located forward of the heads of the metatarsal bones were omitted from "SoleSensor" construction to decrease (as we assume) permanent irritation in these areas, but subsequently thwarting detection of COG near the part of plantar sole perimeter.

The present invention overcomes these disadvantages.

SUMMARY OF THE INVENTION

The present invention overcomes disadvantages of prior art by providing an article of footwear and an insert for an article of footwear with utilization of Hydraulic Forces to Control Protrusions Position.

Particularly, we propose a novel structure that makes automatic rise of protrusions on the insole perimeter area activated by increased pressure from periphery of the plantar foot surface by means of hydraulic forces of special liquid cells implanted inside of the insole.

Our current solution is intended to facilitate sensation when loss of balance could be imminent, by intrinsically improving the wearer's somatosensory awareness and stability during stand and gait; however this balance enhancing solution excludes permanent discomfort/irritation of pins intrusion into plantar sole skin. It makes possible well-timed amplification of partial area of cutaneous pressure sensation without residual effects.

From a biomechanical engineer's perspective, this system could be considered as a nonlinear active dynamic filter that will compensate not only deficiency of elevated sole mechanoreceptors threshold related to age of illness, but also through non-discomfort enhancement the proprioception of plantar sole would return a degree of barefoot feel conditions for the broader wearers' population, such as dynamic sport participants: basketball, tennis, and others.

This would revolutionize the development of a bioengineering technique for improving balance control in patients with somatosensory deficits, and could thus serve to reduce cost of falling and the morbidity frequency, and assist people with somatosensory deficits in achieving maximal independence in activities of daily living and mobility.

BRIEF DESCRIPTION OF THE DRAWINGS

The invention will now be described, by way of example only, with reference to the following drawings in which.

DETAILED DESCRIPTION OF THE DRAWINGS

Figure 1:
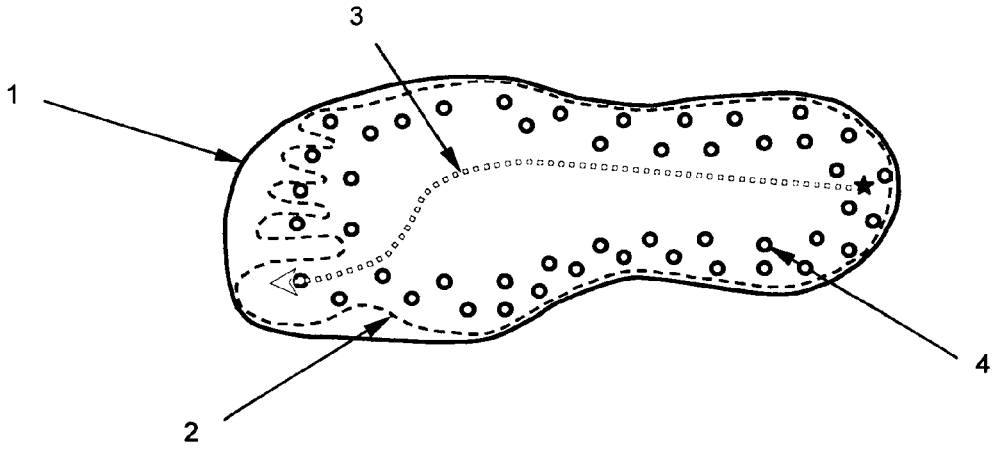
FIG. 1 illustrates an outline of the insole and preferred areas for stimulation of cutaneous pressure sensation.

FIG. 1 illustrates schematically an outline of the insole 1, plantar foot surface outer perimeter (dotted line) 2, typical trajectory of COP along a plantar sole during of normal walking 3, and set of inserts 4, along the narrow areas corresponding to an inner neighborhood of the plantar foot. surface perimeter in which cutaneous sensation is to be stimulated in accordance with the present invention. The narrow strip of intrusions 1 fills an inner neighborhood of plantar sole perimeter—these inserts do not create permanent intrusions into plantar sole, and thus cannot create desensitization of the affected part of the sole's somatosensory system with time. Typical trajectory of COP along a plantar sole during of normal walking clarifies the importance of detection of any COP position deviation toward the plantar sole perimeter that can result in loss of balance. For timely balance recovery an early detection of COP position deviation would help the individual to correct its balance by compensatory stepping reactions in response to unpredictable, multi-directional perturbation.

Figure 2:
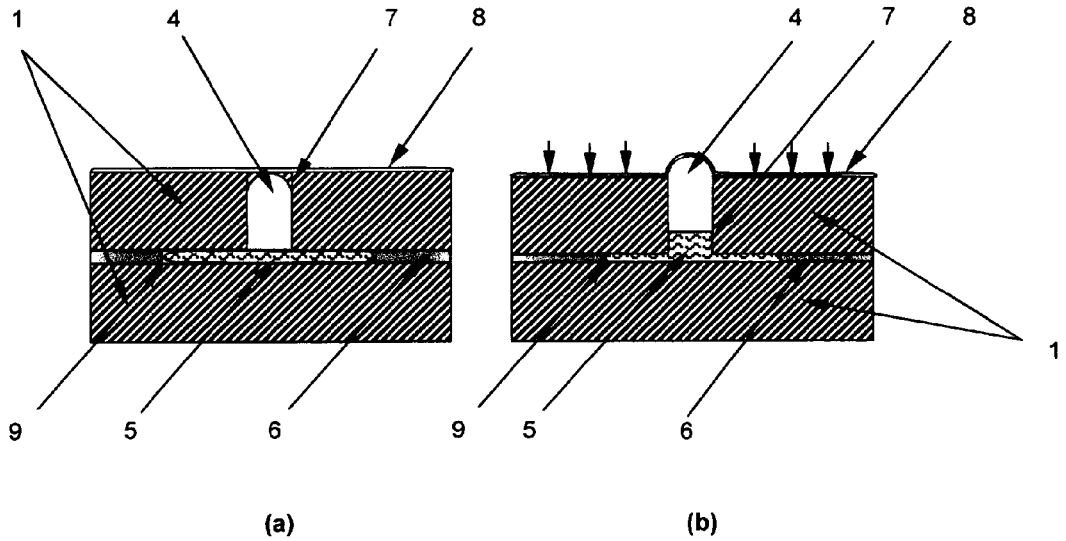
FIG. 2 illustrates schematically a composite insert without and under sole plantar pressure, which includes two layers of hard plastic insole material with an in-between thin rubber layer to house micro-pillows in prepared outlets, see FIG. 4.

FIG. 2 shows a fragment of the insole where 4 is composite insert (pin) in the channel 7 in the absence of sole pressure (FIG. 2*a*) buried in the insole body composed from two layers of hard material (rubber/plastic) 1 with micro-pillow 5 filled with liquid (liquid silicone for example), and thin compressible rubber layer 6 with outlet to house micro-pillow. A flexible/stretchable membrane 8 covers upper surface of the insole that contacts the plantar sole. The same insert sticks out into plantar sole under sole plantar pressure (FIG. 2*b*). For the micro-pillow could be used flexible stretchable membrane.

Figure 3:
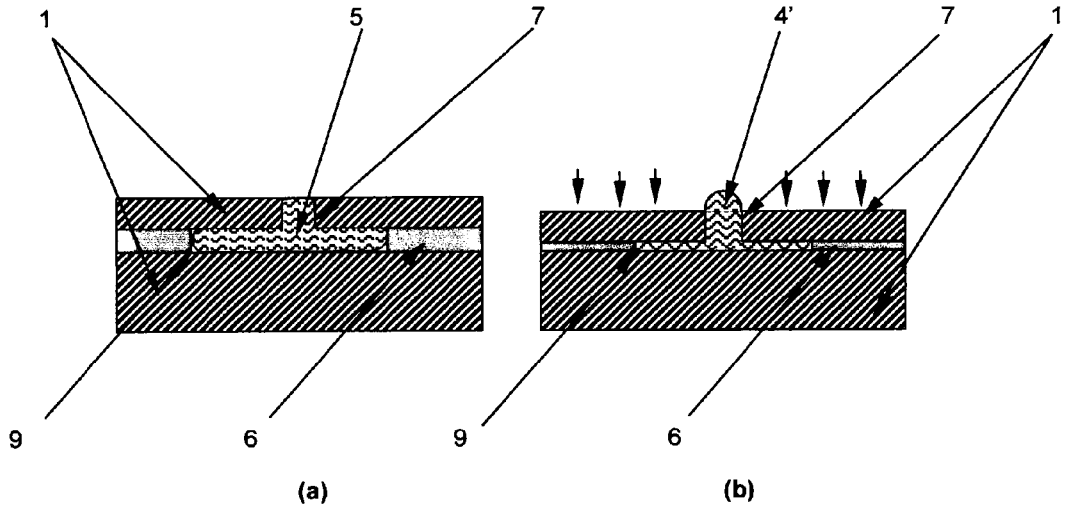
FIG. 3 illustrates schematically a different solution of insert, which explores reconfigured micro-pillow (cell), which itself creates the protrusion under pressure.
Figure 4:
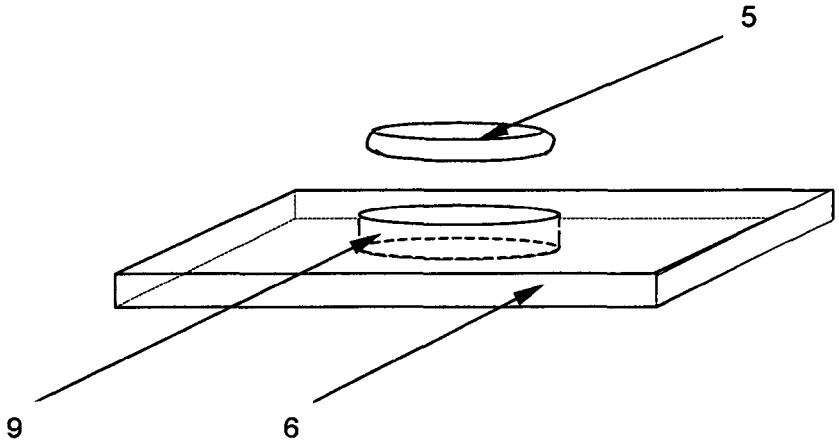
FIG. 4 illustrates schematically a thin rubber washer layer to house micro-pillows in prepared outlet.

Other example of insert structure is shown on FIG. 3, where a micro-pillow 5 itself pre-fills the channel 7 FIG. 3*a*, and creates itself a protrusion trough channel 7 under increased sole plantar pressure, FIG. 3*b*.

A thin rubber washer layer 1 to house micro-pillow 3 in prepared outlet 2 is placed in-between two layers of hard plastic insole material. For the protrusion's diameter about 3 mm, and maximum elevation about 5 mm, then, taking into account that volume of the liquid in the micro-pillow is constant (the liquid is uncompressible!), we will use thin rubber washer layer (and micro-pillow) height approximately 1 mm with diameter of micro-pillow (and outlet) that is approximately 6.7 mm. Since closing of COP to the plantar sole perimeter would increase pressure along some perimeter section, it would be practical to assemble several protrusions for one prolonged micro-pillow with its outlet shaped accordingly.

Figure 5:
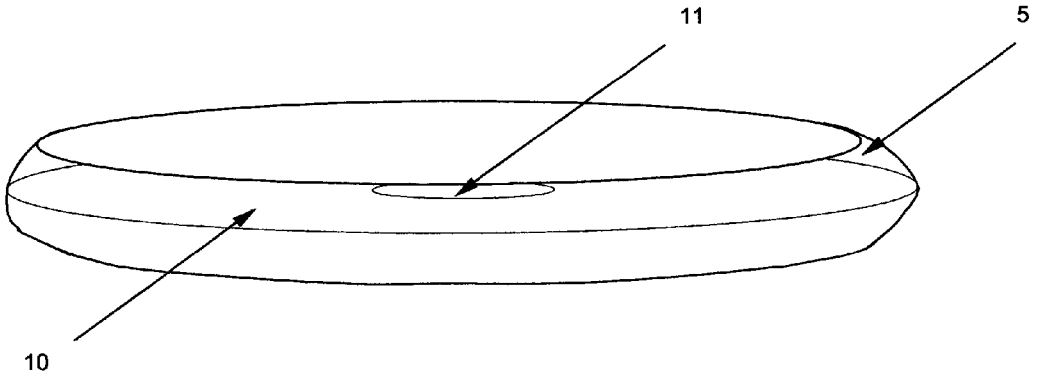
FIG. 5 shows micro-pillow with thin membrane that splits micro-pillow volume. The membrane has a small hall in the center—a throttle to delay liquid flow that elevates/creates a protrusion.

To prevent unnecessary intrusion of protrusion into plantar sole during passing COP toward sole perimeter micro-pillow liquid filler viscosity should be calculated to delay liquid flow into protrusion channel for a fraction of second. Additional means to organize such a delay will be inclusion of membrane-separator inside of micro-pillow with a small hall—the throttle as shown on FIG. 5.

Although the invention has been described in relation to certain preferred embodiments, it is to be understood that the invention is not restricted thereto. Rather, the invention includes all embodiments which may fall within the scope of the following claims.

What is claimed is:

1. An insole for an article of footwear, said insole comprising:

a top and bottom layers made out of hard material, and a compressible middle layer sandwiched between said layers;

said top layer carrying a plurality of apertures located within the neighborhood of the perimeter of said top layer;

said inner layer having a plurality of compressible housings substantially aligned with said plurality of apertures of said top layer, each said housing serving as a receiver for at least one liquid filled elastic cell so that said cells in said housings are also substantially aligned with said apertures of the top layer; whereby when a particular area of the peripheral portion of the top layer of the insole in the neighborhood of the perimeter is pressed due to the wearer's center of pressure shifting towards that peripheral portion of the foot, the corresponding subjacent portion of the compressible middle layer is compressed, with the result that one or more of the corresponding compressible housings and any liquid filled elastic cell in the area is compressed, thereby forcing the liquid in the elastic cell and the elastic cell through the corresponding aperture in the top layer so as to cause a protrusion to rise above the top surface of the top layer, each said protrusion stimulating a peripheral portion of the plantar sole skin mechanoreceptors of a wearer whenever the wearer's center of gravity shifts towards that peripheral portion of the foot.

2. The insole of claim 1, wherein there is a slidable element of firm material within the aperture, such, that when a portion of the liquid filled elastic cell is forced into the aperture the slidable element rises above the top surface of the top layer and acts like a pin on the bottom of the foot of a wearer.

3. The insole of claim 1, wherein a flexible, stretchable membrane placed over the top layer.

4. The insole of claim 1, wherein said liquid filled elastic cell is partitioned by a membrane with a small hall creating a throttle effect to delay liquid flow to prevent unnecessary intrusion of protrusion into the plantar sole of a wearer during brief center of pressure reaching sole perimeter.

5. An article of footwear, having the sole itself construction of the insole in claim 1.

* * * * *